US007762808B2

(12) United States Patent
Lee et al.

(10) Patent No.: US 7,762,808 B2
(45) Date of Patent: Jul. 27, 2010

(54) REGENERATIVE THERMAL OXIDIZER

(75) Inventors: Hyun-jae Lee, Daejon (KR); Myeong-soo Yoon, Daejon (KR); Myeong-gug Chae, Seoul (KR); Sang-bock Lee, Daejon (KR)

(73) Assignee: Enbion Inc., Daejon (KR)

( * ) Notice: Subject to any disclaimer, the term of this patent is extended or adjusted under 35 U.S.C. 154(b) by 789 days.

(21) Appl. No.: 10/576,488

(22) PCT Filed: Oct. 23, 2003

(86) PCT No.: PCT/KR03/02237

§ 371 (c)(1),
(2), (4) Date: Mar. 1, 2007

(87) PCT Pub. No.: WO2005/039741

PCT Pub. Date: May 6, 2005

(65) Prior Publication Data

US 2007/0269759 A1 Nov. 22, 2007

(51) Int. Cl.
*F27D 17/00* (2006.01)

(52) U.S. Cl. ..... 432/180; 432/181; 165/8

(58) Field of Classification Search ..... 432/179–181; 165/8–10; 422/173–179; 122/1 A
See application file for complete search history.

(56) References Cited

U.S. PATENT DOCUMENTS 5,016,547 A * 5/1991 Thomason ..... 110/211
5,562,442 A 10/1996 Wilhelm
5,871,349 A * 2/1999 Johnson et al. ..... 432/180
5,967,771 A * 10/1999 Chen et al. ..... 432/180
6,193,504 B1 * 2/2001 Chen et al. ..... 432/72
6,203,316 B1 * 3/2001 Pennington ..... 432/180
6,298,877 B1 * 10/2001 Inuki et al. ..... 137/625.11
6,640,752 B1 * 11/2003 Counterman ..... 122/1 A
6,974,318 B2 * 12/2005 Ahn et al. ..... 432/180

FOREIGN PATENT DOCUMENTS

| | | |
|---|---|---|
| EP | 1145755 | 10/2001 |
| JP | 2000274644 | 10/2000 |
| JP | 2000334267 | 12/2000 |
| KR | 20010044153 | 6/2001 |

* cited by examiner

*Primary Examiner*—Gregory A Wilson
(74) *Attorney, Agent, or Firm*—The Webb Law Firm

(57) ABSTRACT

The present invention provides a regenerative thermal oxidizer which burns and eliminates harmful process gases generated in industrial sites. The present invention provides the regenerative thermal oxidizer in which different parts of the rotor are used as inlet and outlet process gas flow paths to increase the ability to process the process gases. According to the present invention, the ability to process the process gases is enhanced in spite of the rotor being similar in size to typical rotors and, as well as, the structure of the rotor and adjacent components is simplified.

8 Claims, 10 Drawing Sheets

"PRIOR ART"

REGENERATIVE THERMAL OXIDIZER

TECHNICAL FIELD

The present invention relates, in general, to thermal oxidizers to burn and eliminate harmful process gases generated at industrial sites and, more particularly, to a regenerative thermal oxidizer which has a heat exchanging part placed in a gas flow path.

BACKGROUND ART

Generally, there are various kinds of thermal oxidizers to oxidize harmful gases, such as volatile organic compounds, resulting from process gases in industrial site and to discharge the oxidized products to the outside. Regenerative thermal oxidizers, which are capable of preheating inlet process gases using the high heat energy of outlet process gases resulting from combustion of the process gases, have advantages of saving energy and of efficiently eliminating harmful gases.

Conventional regenerative thermal oxidizers each include a combustion chamber which burns and oxidizes process gases, a heat exchanging part and a rotor which periodically rotates to supply or discharge the process gases into or from the combustion chamber. Process gases supplied from the rotor are burned in the combustion chamber after passing through the heat exchanging part. Thereafter, the burned process gases are discharged to the outside through the heat exchanging part and the rotor. In this process, a section of the heat exchanging part functioning to discharge gas stores heat energy from combustion gases. The heat energy is used to preheat process gases supplied from the rotor.

FIG. 1 is a partially exploded perspective view of a conventional rotary type regenerative thermal oxidizer.

With reference to FIG. 1, a flow of process gases in the conventional regenerative thermal oxidizer is as follows. The process gases are drawn into a combustion chamber 60 after passing through an inlet pipe 30, an inlet opening 22 of a rotor 20, a plurality of openings 12 of a distribution plate 10, and a heat exchanging part 50, sequentially. The process gases are burned in the combustion chamber 60 and are discharged to the outside after passing through the openings 12 of the distribution plate 10, an outlet opening 24 of the rotor 20 and an outlet duct 40.

An upper surface of the rotor 20 is in close contact with the distribution plate 10 having the plurality of openings 12. Some of the openings 12 formed on the distribution plate 10 correspond to the inlet opening 22 of the rotor 20 and the remainder of the openings 12 correspond to the outlet opening 24 of the rotor 20, thus providing inlet and outlet process gas flow paths, respectively. In other words, the openings 12 of the rotor 20 guide process gases passing through the inlet opening 22 to the heat exchanging part 50 and guide the process gases, which are burned after passing through the heat exchanging part 50, to the outlet opening 24 of the rotor 20. A partitioning unit (not shown) is provided between the heat exchanging part 50 and the distribution plate 10 to prevent the inlet process gases and the burned process gases from mixing with each other.

In the conventional regenerative thermal oxidizer, because the rotor 20 separates inlet and outlet process gases from each other, a flow capacity of process gases is determined by areas of the inlet and outlet openings 22 and 24 of the rotor. Accordingly, to increase the flow of process gases, that is, the ability to process the process gases, the sectional area of the rotor must be increased. This purpose can be achieved by increasing the rotor size. However, to operate a large rotor, a drive unit having high power consumption is required. Due to this feature, manufacturing costs of the regenerative thermal oxidizer and costs of operating it are excessively increased.

The increase in the size of the rotor causes difficulty in maintenance of an airtight state between the rotor and adjacent components. For example, the rotor 20 shown in FIG. 1 must be airtightly coupled to adjacent components, such as an inlet chamber 31, the outlet duct 40 and the distribution plate 10. To achieve the above-mentioned purpose, a sealing material is applied to predetermined portions of the rotor 20. The increase in the size of the rotor brings an increase in the area to which the sealing material must be applied. As a result, difficulty in providing a soundly airtight structure exists.

In the meantime, the regenerative thermal oxidizer must prevent inlet and outlet process gases from mixing with each other in the rotor. As well, the inlet process gas flow path and the outlet process gas flow path must be independently defined in a lower end of the rotor. Furthermore, in the regenerative thermal oxidizer shown in FIG. 1, the outlet duct 40 passing through the inlet chamber 31 is coupled to the rotor 20. As such, the conventional regenerative thermal oxidizer is disadvantageous in that the structure is very complex.

DISCLOSURE OF THE INVENTION

Accordingly, the present invention has been made keeping in mind the above problems occurring in the prior art, and an object of the present invention is to provide a regenerative thermal oxidizer which has a simple structure and increases process gas processing capacity in spite of having a rotor similar in size to typical rotors.

In order to accomplish the above object, the present invention provides a regenerative thermal oxidizer to burn process gases, including: a reaction chamber having a combustion unit to burn the process gases; a heat exchanging part placed to be in contact with the reaction chamber and having a plurality of sectors for heat exchange of the process gases; a first duct communicating with an outside through an upper end of the regenerative thermal oxidizer while passing through the heat exchanging part; a second duct provided on a lower end of the regenerative thermal oxidizer to supply or discharge the process gases into or from the heat exchanging part; a rotor-shaped distribution unit placed to be in close contact with the first duct and provide both a first gas flow path which is associated with the first duct and provided above the rotor-shaped distribution unit and a second gas flow path which is associated with the second duct and provided below the rotor-shaped distribution unit; a plurality of partitioning plates to define the sectors of the heat exchanging part while extending to a lower end of the heat exchanging part to prevent the process gases passing through the first and second gas flow paths from mixing with each other; and a drive unit to rotate the rotor at a predetermined speed.

According to an embodiment of the present invention, the rotor-shaped distribution unit of the regenerative thermal oxidizer may comprise a cylindrical rotor provided under the heat exchanging part, and including: an upper opening provided on an upper surface of the cylindrical rotor which is in contact with the first duct; and a lower opening provided on a lower surface of the cylindrical rotor opposite to the upper opening, so that the upper opening provides a first gas flow path to connect a part of the sectors of the heat exchanging part to the outside of the regenerative thermal oxidizer through the first duct, and the lower opening provides a second gas flow path to connect another part of the sectors of the heat exchanging part to the outside of the regenerative thermal oxidizer through the second duct.

The cylindrical rotor may include upper and lower cylinders which are integrally operated, so that the upper opening is provided on the upper surface of the upper cylinder and the lower opening is provided on the lower surface of the lower cylinder. The upper and lower cylinders comprise first and second side openings, respectively, so that both the upper opening and the first side opening are placed on the first gas flow path while both the lower opening and the second side opening are placed on the second gas flow path. The upper opening may be provided on a central portion of the upper surface of the cylindrical rotor, and the lower opening may be provided along a circumference of the lower surface of the cylindrical rotor. The cylindrical rotor may further include first and second side openings provided on opposite sidewalls of the cylindrical rotor, and both the upper opening and the first side opening are placed on the first gas flow path while both the second side opening and the lower opening are placed on the second gas flow path.

According to another embodiment of the present invention, the rotor-shaped distribution unit may comprises a plate type distribution rotor provided under the heat exchanging part, and including: a gas outlet having a plurality of slots, communicating with the first duct, and provided on a central portion of the plate type distribution rotor; a plurality of openings provided on predetermined positions along a circumference of the plate type distribution rotor, so that the gas outlet having the plurality of slots provides a first gas flow path to connect a part of the sectors of the heat exchanging part to the outside of the regenerative thermal oxidizer through the first duct, and the plurality of openings provides a second gas flow path to connect another part of the sectors of the heat exchanging part to the outside of the regenerative thermal oxidizer through the second duct.

According to a further embodiment of the present invention, the rotor-shaped distribution unit may comprise a ring type distribution rotor provided under the heat exchanging part, and including: two concentric rings comprising an inner ring and an outer ring; and at least two partitioning blades extending from an outer surface of the inner ring to the outer ring to partition the outer ring into at least two sections, so that the inner ring is coupled to the first duct and provides a first gas flow path to connect a part of the sectors of the heat exchanging part to the outside of the regenerative thermal oxidizer through the first duct and a side opening of the inner ring, and the outer ring provides a second gas flow path to connect another part of the sectors of the heat exchanging part to the outside of the regenerative thermal oxidizer through the second duct and a part of the sections partitioned by the partitioning blades.

As described above, the present invention provides a regenerative thermal oxidizer in which different parts of the rotor are used as inlet and outlet process gas flow paths, thus increasing process gas processing capacity in spite of having a rotor similar in size to typical rotors, and simplifying the structure of the rotor and adjacent components.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
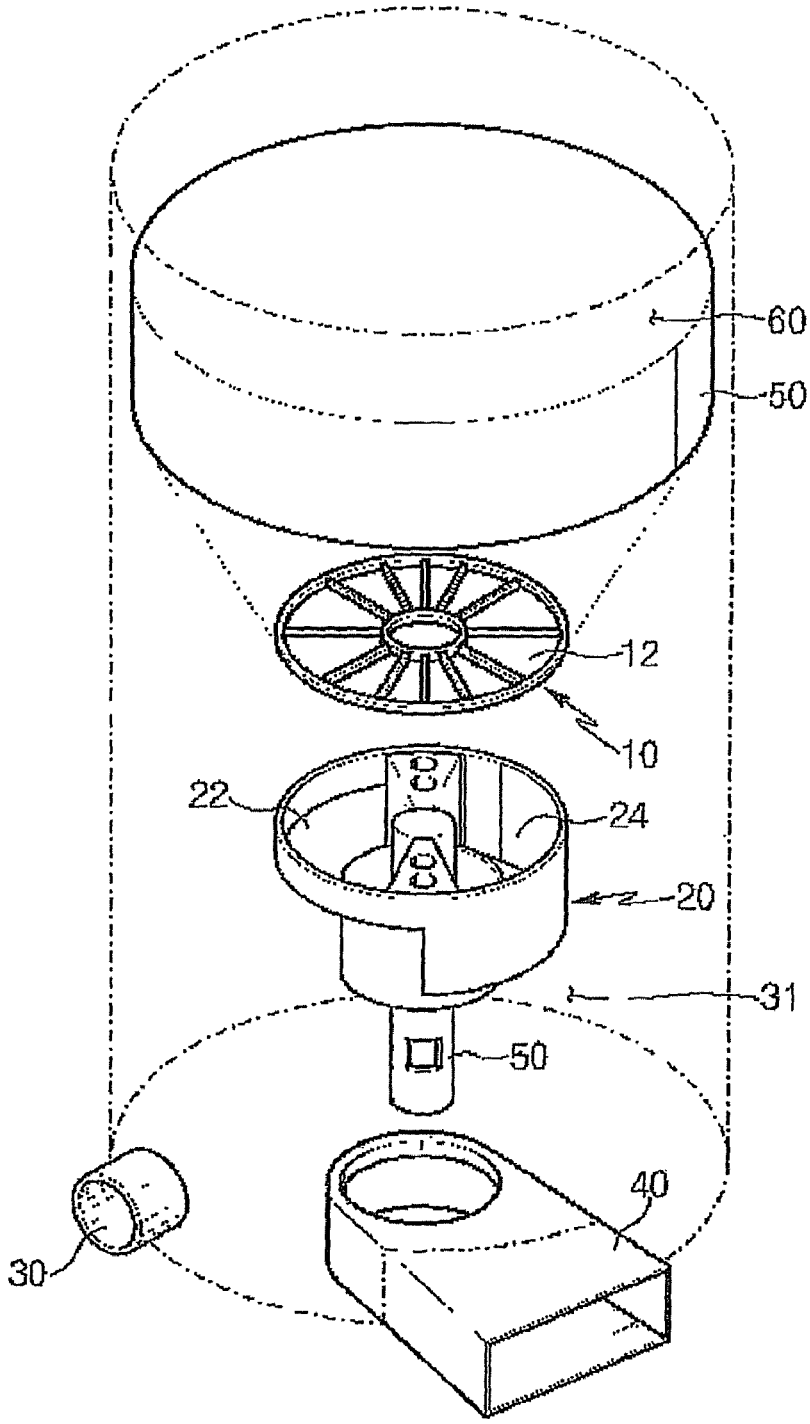
FIG. 1 is a partially exploded perspective view of a conventional rotary type regenerative thermal oxidizer centered on a rotor.

Hereinafter, embodiments of the present invention will be described in detail with reference to the accompanying drawings.

In description of the embodiments of the present invention, for the sake of convenience, a rotary type device for distribution of process gases is classified into a cylinder type distribution rotor and a plate type distribution rotor. The cylinder type distribution rotor means a rotor in which spaces for distribution of process gases are defined. The plate type distribution rotor means a rotor in which a planar distribution unit guides process gases in predetermined directions, but this rotor does not use an inner space thereof for the distribution of the process gases. Reference should now be made to the drawings, in which the same reference numerals are used throughout the different drawings to designate the same or similar components.

Regenerative Thermal Oxidizer Having Cylinder Type Distribution Rotor

Figure 2:
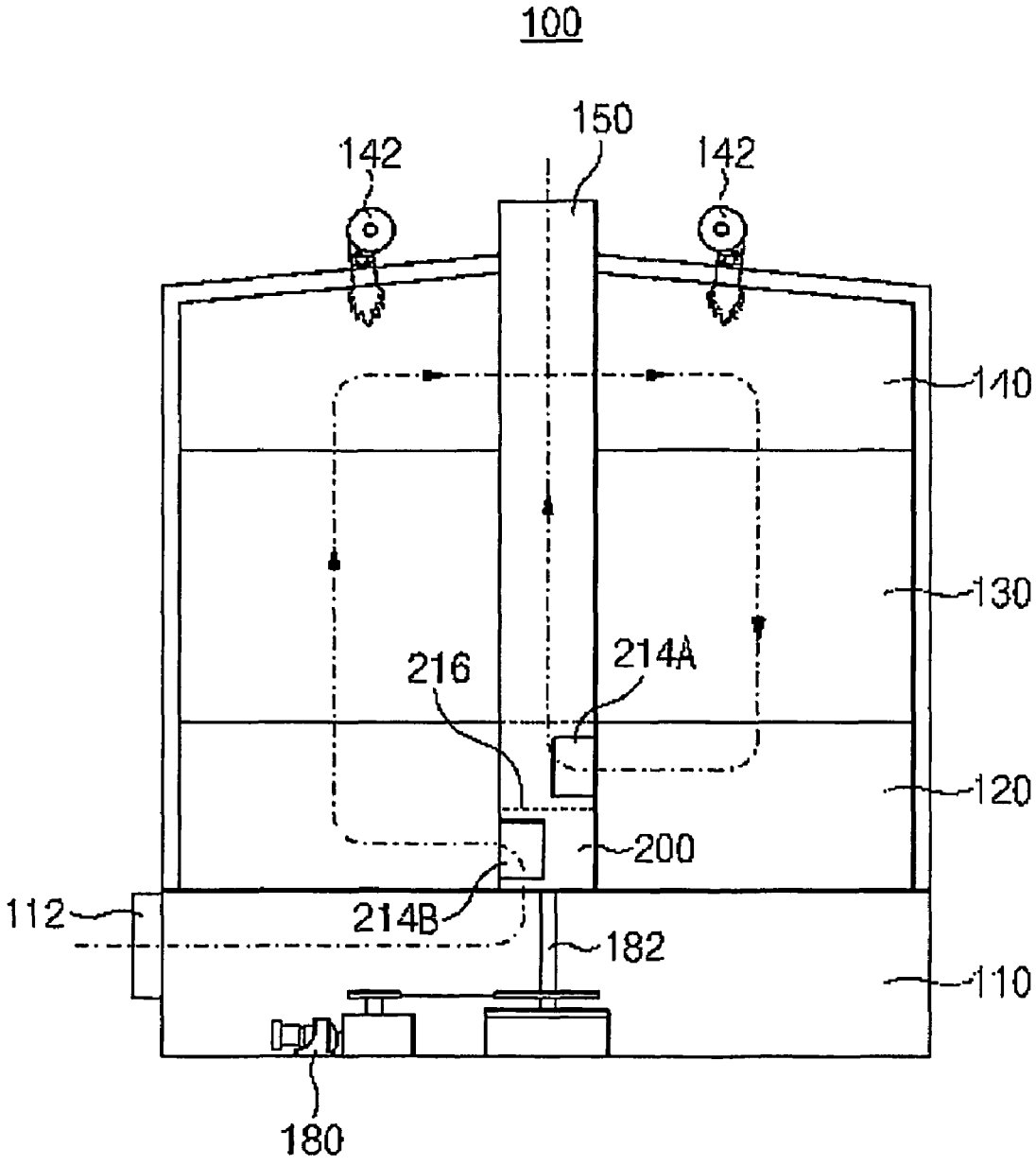
FIG. 2 is a sectional view of a regenerative thermal oxidizer having a cylinder type distribution rotor as a distribution unit, according to an embodiment of the present invention.
Figure 3:
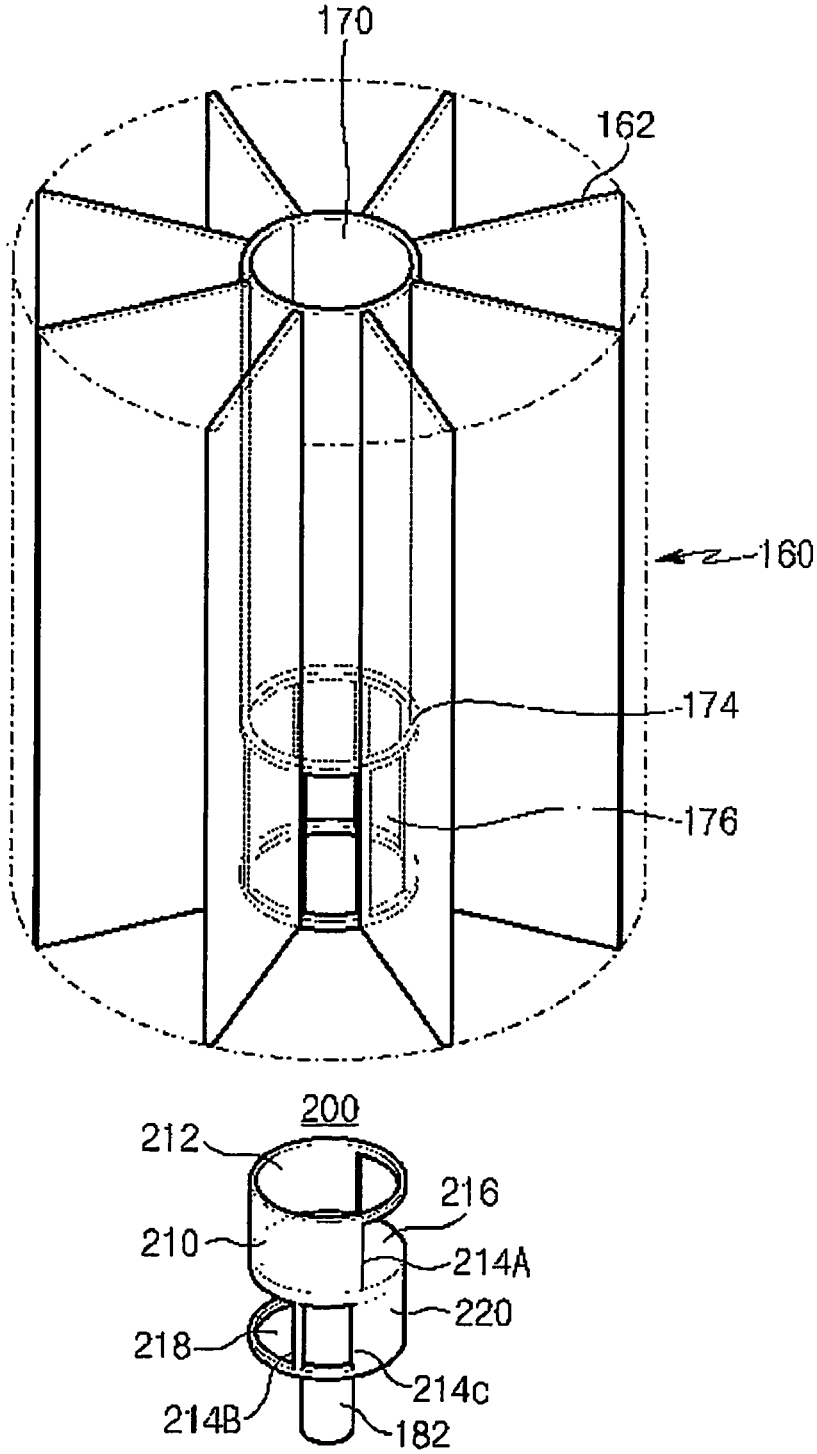
FIG. 3 is a perspective view to show in detail the construction of the rotor used in the regenerative thermal oxidizer of FIG. 2.
Figure 4:
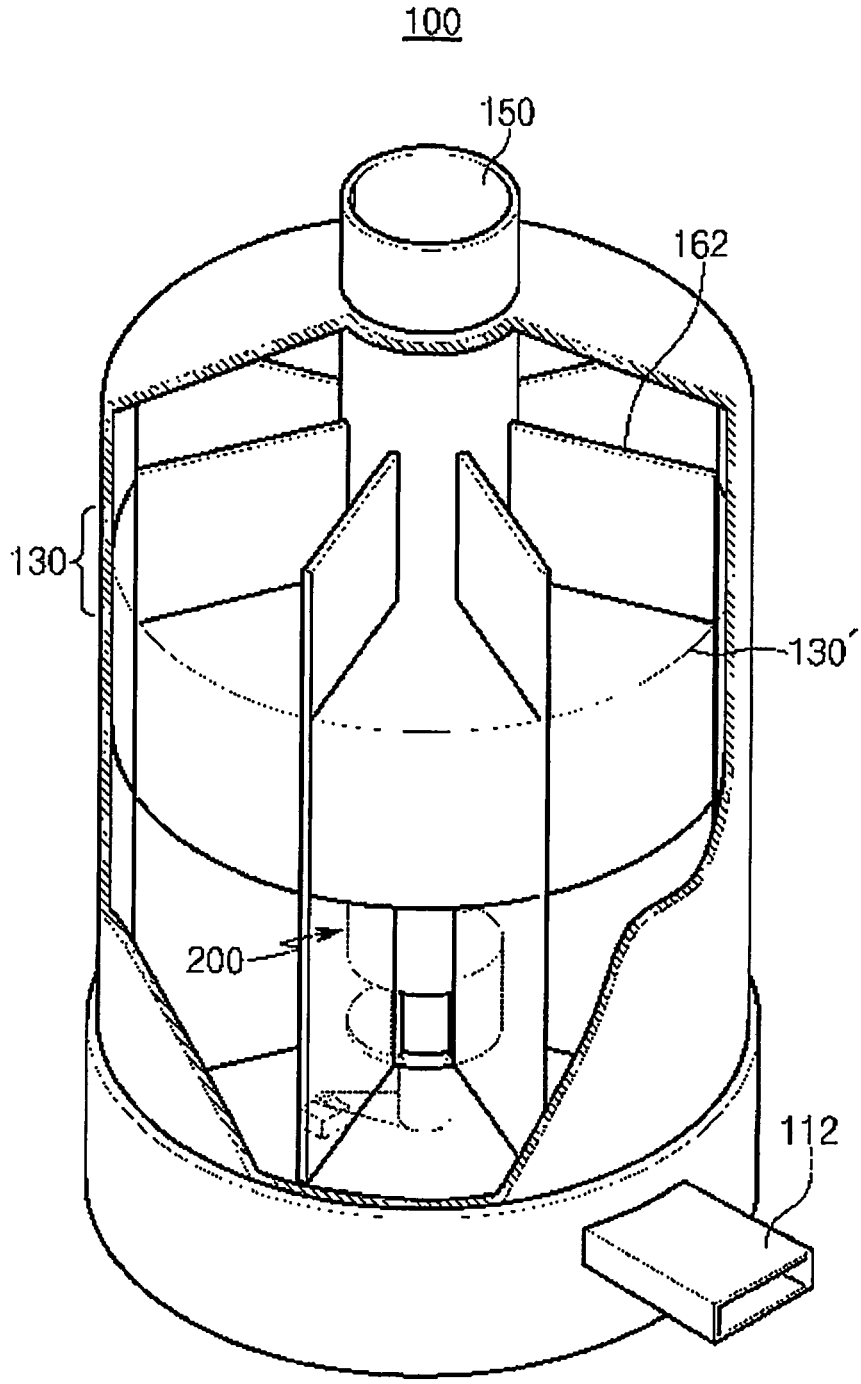
FIG. 4 is a perspective view of the regenerative thermal oxidizer having the rotor of FIG. 3.

FIGS. 2 through 4 are views of a regenerative thermal oxidizer having a cylinder type distribution rotor as a distribution unit, according to a first embodiment of the present invention.

FIG. 2 is a sectional view of the regenerative thermal oxidizer 100 of the present invention. As shown in the drawings, the regenerative thermal oxidizer 100 according to the first embodiment includes a heat exchanging part 130. The heat exchanging part 130 partitions the interior of the regenerative thermal oxidizer 100 into upper and lower parts. The upper part of the regenerative thermal oxidizer 100 defines a combustion chamber 140 therein and the lower part of the regenerative thermal oxidizer 100 defines a distribution chamber 120 therein. The combustion chamber 140 has a combustion unit 142, such as a burner, to burn process gases.

As shown by the arrow, process gases, drawn into the regenerative thermal oxidizer 100 through a second duct 112, pass through a cylinder type distribution rotor 200, the distribution chamber 120, the heat exchanging part 130 and the combustion chamber 140 and are burned in the combustion chamber 140. The burned process gases again pass through the heat exchanging part 130, the distribution chamber 120 and the rotor 200 and, thereafter, the burned process gases are exhausted to the outside through a first duct 150 passing through the heat exchanging part 130.

FIG. 3 is a perspective view to show in detail the construction of the rotor used in the regenerative thermal oxidizer according to the first embodiment of the present invention. The rotor 200 is cylindrical. The interior of the rotor 200 is partitioned by an intermediate plate 216 into upper and lower parts. A first side opening 214A and a second side opening 214B are provided on sidewalls of the upper and lower parts of the rotor 200, respectively. Furthermore, an upper opening 212 and a lower opening 218 are provided on upper and lower surfaces of the rotor 200, respectively. The openings 212, 214A, 214B and 218 define inlet and outlet process gas flow paths. In consideration of rotation of the rotor 200, the first side opening 214A and the second side opening 214B are formed at diametrically opposite positions on the rotor 200 to be symmetrical to each other, based on a rotating shaft 182 of the rotor 200. The rotating shaft 182 is coupled to the intermediate plate 216 of the rotor 200.

Referring to FIG. 3, the rotor 200 is inserted into a separator 160 in the regenerative thermal oxidizer 100. The separator 160 supports a plurality of sectors of the heat exchanging part 130 therein and, in addition to, defines the distribution chamber 120 under the heat exchanging part 130. As shown in the drawings, the separator 160 includes a cylindrical pipe 170 constituting the first duct 150. The separator 160 further includes a plurality of partitioning plates 162 which diametrically extend from the cylindrical pipe 170 outwards. The partitioning plates 162 support the heat exchanging part 130 and prevents inlet process gases and outlet process gases from mixing with each other in the distribution chamber 120. A plurality of slots 176 is provided on a sidewall 174 of a lower end of the cylindrical pipe 170 of the separator 160 to supply or discharge the process gases into or from the distribution chamber 120. The slots 176 corresponding to the first and second side openings 214A and 214B of the rotor 200 provide the inlet and outlet process gas flow paths.

The inlet and outlet process gas flow paths will be described herein below, with reference to FIGS. 2 and 3. As shown by the arrow of the one-dot chain line, the process gases, drawn into the regenerative thermal oxidizer 100 through the second duct 112, are supplied into the distribution chamber 120 through the lower opening 218 and the second side opening 214B of the rotor 200. Thereafter, the process gases are burned by the burner after passing through the heat exchanging part 130. The burned process gases again pass through the heat exchanging part 130 and the distribution chamber 120 prior to being drawn into the rotor 200 through the first side opening 214A of the rotor 200. Thereafter, the burned process gases are discharged to the outside through the upper opening 212 and the first duct 150. As described above, in the flow of the process gases from the distribution chamber 120 to the first side opening 214A and in the flow of the process gases from the second side opening 214B to the distribution chamber 120, the process gases always pass through the plurality of slots 176 formed on the sidewall 174 of the lower end of the separator 160. Here, each of the slots 176 of the sidewall 174 of the lower end of the separator 160 may be divided into upper and lower parts to provide securely airtight flow of the process gases, but this is not shown in the drawings.

In the regenerative thermal oxidizer 100 of the present invention, the lower opening 218 for the inflow of the process gases and the upper opening 212 for the discharge of the burned process gases are formed on opposite surfaces of the rotor 200. Due to this structure, the flow of the process gases drawn into the rotor 200 and the flow of the burned process gases discharged from the rotor 200 are parallel with each other in the same direction. Unlike this feature, in conventional thermal oxidizers, process gases are drawn into and discharged from a cylinder through an opening formed on a lower surface of the cylinder, so that flows of inlet and outlet process gases are parallel to each other in opposite directions.

As such, in conventional thermal oxidizers, the lower surface of the cylinder serves as both the inlet opening and the outlet opening. However, in the regenerative thermal oxidizer of the present invention, because the lower and upper surfaces of the rotor are used for the inflow and outflow of the process gases, respectively, a great amount of process gas can be processed. Furthermore, in the regenerative thermal oxidizer of the present invention, the second duct 112 for the inflow of the process gases and the first duct 150 for the outflow of the process gases are spatially separated from each other. Therefore, the pipe arrangement in the regenerative thermal oxidizer, as well as the construction of the rotor, is markedly simplified.

FIG. 4 is a perspective view of the regenerative thermal oxidizer having the rotor of FIG. 2. As shown in FIG. 4, a plurality of sectors 130' of the heat exchanging part 130 is provided in the separator of the regenerative thermal oxidizer. The heat exchanging part 130 is made of predetermined material, in which a plurality of fine channels, that is, open pores, are formed, to exchange heat with the process gases while the process gases pass through the heat exchanging part 130. As shown in the drawings, the heat exchanging part 130 includes the plurality of sectors 130' each having a pie shape and a predetermined internal angle. The sectors 130' are separated from each other by the partitioning plates 162 of the separator 160. The first duct 150 passes through the heat exchanging part 130 along a longitudinal axis of the heat exchanging part 130 to discharge burned process gases. The cylinder pipe 170 of the separator 160, which is described above with reference to FIG. 3, constitutes the first duct 150. An end of the first duct 150 is in close contact with the upper opening (212 in FIG. 3) of the rotor. The other end of the first duct 150 extends to the outside of the regenerative thermal oxidizer after passing through the heat exchanging part 130.

The partitioning plates 162 separate the sectors 130' of the heat exchanging part 130 and extend to a lower end of the rotor 200 to form the distribution chamber 120 in the regenerative thermal oxidizer 100. By the partitioning plates 162, the inlet and outlet process gases, which respectively flow along the inlet and outlet process gas flow paths defined by the second side opening 214B and the first side opening 214A of the rotor, are prevented from mixing with each other. Therefore, each of the sectors 130' of the heat exchanging part 130 is classified by the partitioning plates 162 into a process gas inflow side or a process gas outflow side.

The rotor 200 is rotated by a motor 180 coupled to the rotating shaft 182. For example, the rotor 200 is intermittently rotated as an angular unit corresponding to the internal angle of each of the sectors 130' of the heat exchanging part 130. According to the rotation of the rotor 200, each of the first side opening 214A and the second side opening 214B corresponds to other sectors 130' of the heat exchanging part 130. In other words, the sectors 130', which have been in the process gas outflow side, are moved into the process gas inflow side by the rotation of the rotor 200. Thus, new process gases, which flow in the process gas inflow side, can be preheated by heat energy which is stored in the sectors 130', which have been in the process gas outflow side, by exchanging heat with the burned process gases in the process gas outflow side.

As shown in FIG. 3, each of the first and second side openings 214A and 214B of the rotor 200 has an elongate slot. However, alternatively, each of the openings 214A and 214B may comprise a plurality of slots each having a predetermined circumferential length corresponding to an inside circumferential length of each of the sectors 130' of the heat exchanging part 130.

Furthermore, the regenerative thermal oxidizer 100 according to the first embodiment may define therein a purge gas feed path for a supply of purge gas, as well as the inlet and outlet process gas flow paths, but the purge gas feed path is not shown in the drawings. To achieve the above-mentioned purpose, an additional opening 214C may be formed on a predetermined portion of the rotor 200 to be aligned with a space between the first side opening 214A and the second side opening 214B. An axial center part of the rotating shaft 182 of the rotor 200 serves as a purge gas feed pipe and communicates with the opening 214C, thus defining the arrangement of the purge gas feed path. A design of the rotor adapted for the purge gas feed path is easily understood by a skilled person, therefore further explanation is deemed unnecessary.

Hereinafter, a regenerative thermal oxidizer having a cylinder type distribution rotor as a distribution unit according to a second embodiment of the present invention will be described, with reference to FIGS. 5 and 6.

Figure 5:
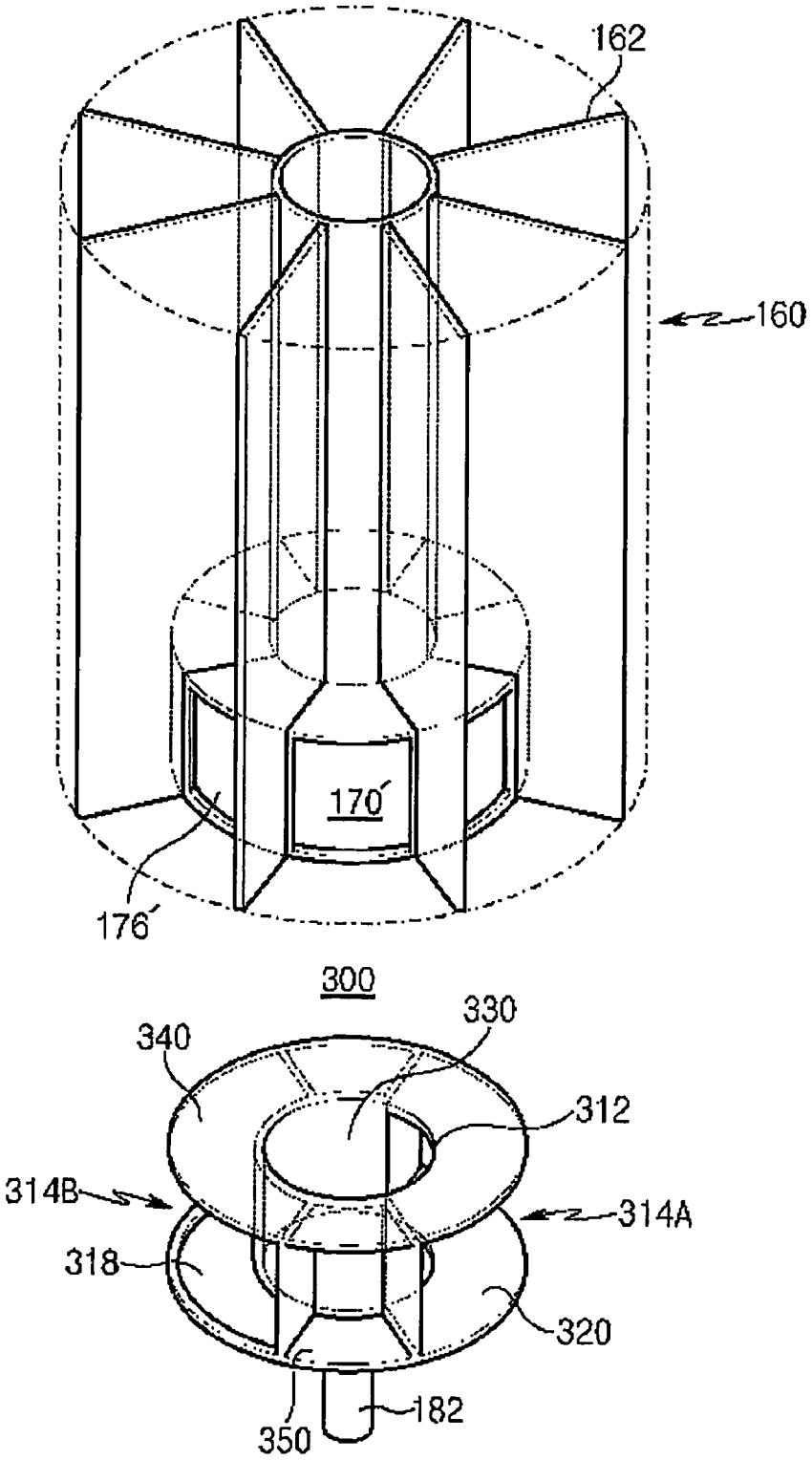
FIG. 5 is a perspective view to show a distribution unit having a cylindrical distribution rotor type, according to another embodiment of the present invention.

FIG. 5 is a perspective view to show the construction of the cylinder type distribution rotor 300 used in the second embodiment. The rotor 300 shown in FIG. 5 has a larger diameter and a lower height than the rotor of the first embodiment shown in FIG. 3. However, process gases are drawn from a lower end of the rotor and discharged through an upper end of the rotor in the same manner as that described for the rotor shown in FIG. 3.

Referring to FIG. 5, the rotor 300 of the second embodiment has a cylindrical shape. The rotor 300 has a lower plate 320 and an upper plate 340 having a circular opening 312. A lower opening 318 has an arc shape and is formed along a circumference of the lower plate 320 of the rotor 300 to be elongated by a predetermined length. Two side openings 314A and 314B are provided on a sidewall of the rotor 300 for inflow and outflow of process gases. The upper opening 312, the lower opening 318 and the two side openings 314A and 314B form inlet and outlet process gas flow paths, guide the process gases into a combustion chamber, and allow the burned process gases to be discharged to the outside. A rotating shaft 182 is coupled to the lower plate 320 of the rotor 300.

Figure 6:
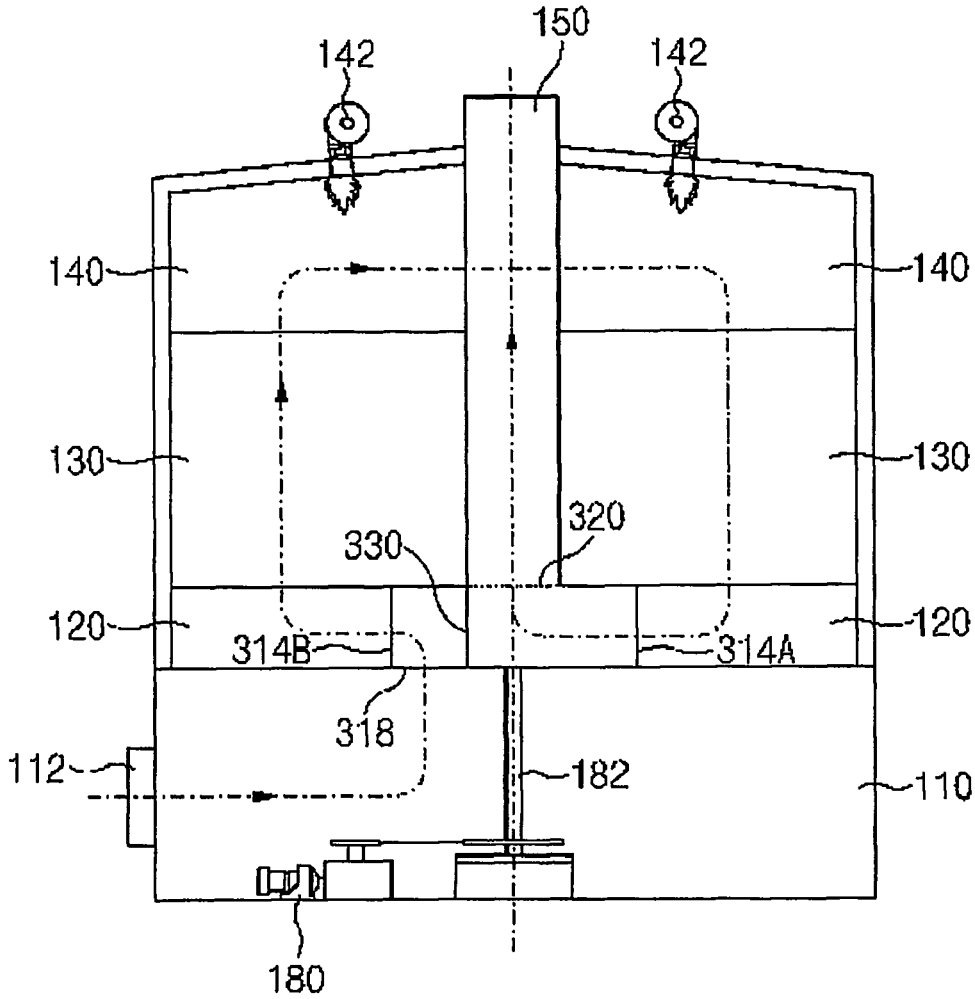
FIG. 6 is a sectional view of a regenerative thermal oxidizer having the rotor of FIG. 5.

The lower opening 318 and the second side opening 314B of the rotor 300 guide process gases, drawn into the regenerative thermal oxidizer, to a distribution chamber (120 in FIG. 6). The first side opening 314A and the upper opening 312 guide the burned process gases from the distribution chamber 120 to a first duct (150 in FIG. 6). The process gases passing through both the lower opening 318 and the second side opening 314B are isolated by an inner wall 330 of the rotor 300 from the burned process gases passing through the first side opening 314A and the upper opening 312. When the rotor 300 is coupled to a separator 160, the upper surface 340 of the rotor 300 is rotatably in close contact with the first duct 150.

The rotor 300 is inserted into the separator 160. The separator 160 supports a plurality of sectors of a heat exchanging part and defines therein the distribution chamber 120 below the heat exchanging part in the same manner as that described for the first embodiment. The separator 160 has an inner spatial part 170' which receive the rotor 300 therein. Furthermore, a plurality of openings 176' is formed on a sidewall of the inner spatial part 170' to correspond to the side openings 314A and 314B of the rotor.

In the meantime, as shown in the drawings, the rotor 300 may further include an additional opening 350 for the supply of purge air. The opening 350 is formed on a predetermined portion of the rotor 300 to be aligned with a space between the first and second side openings 314A and 314B. The opening 350 guides the purge air through the distribution chamber 120 to a part of the heat exchanging part 130 corresponding to the opening 350, thus purging the corresponding part of the heat exchanging part 130. When purge air is drawn at a pressure higher than process gases, the supplied purge air may serve as an air curtain for preventing inlet process gases and outlet process gases from mixing with each other. The purge air feed pipe is not shown in the drawings, but it may be designed in a typical method. For example, an axially hollow center part of the rotating shaft 182 serves as the purge air feed pipe and communicates with the opening 350 through the interior of the rotor 300, thus defining the arrangement of the purge gas feed path.

FIG. 6 is a sectional view of the regenerative thermal oxidizer having the rotor of the second embodiment. Referring to FIG. 6, process gases drawn through a second duct 112 pass through the lower opening 318 and second side opening 314B of the rotor 300, the distribution chamber 120 and the heat exchanging part 130 (see, the arrow of the one-dot chain line). Thereafter, the process gases are burned in a combustion chamber 140. The burned process gases again pass through the heat exchanging part 130 and the distribution chamber 120 prior to being discharged to the outside through the first side opening 314A and the upper opening 320 of the rotor 300.

In the same manner as that of the first embodiment, the heat exchanging part 130 includes sectors which have pie shapes and are separated from each other by partitioning plates 162 of the separator 160. The partitioning plates 162 extend to a lower end of the rotor 300 and form the distribution chamber 120 preventing inlet and outlet process gases from mixing with each other around the rotor 300.

The principle of the heat exchange occurring between the heat exchanging part 130 and the process gases during the rotation of the rotor 300 is the same as that of the first embodiment, therefore further explanation of the principle is deemed unnecessary.

Regenerative Thermal Oxidizer Having Plate Type Distribution Rotor

Until now, although the regenerative thermal oxidizer having the cylinder type distribution rotor has been described, the spirit of the present invention can be adapted to various regenerative thermal oxidizers without being limited to the above-mentioned art. Hereinafter, a regenerative thermal oxidizer having a plate type distribution rotor functioning as a distribution unit is described with reference to FIGS. 7 through 10.

Figure 7:
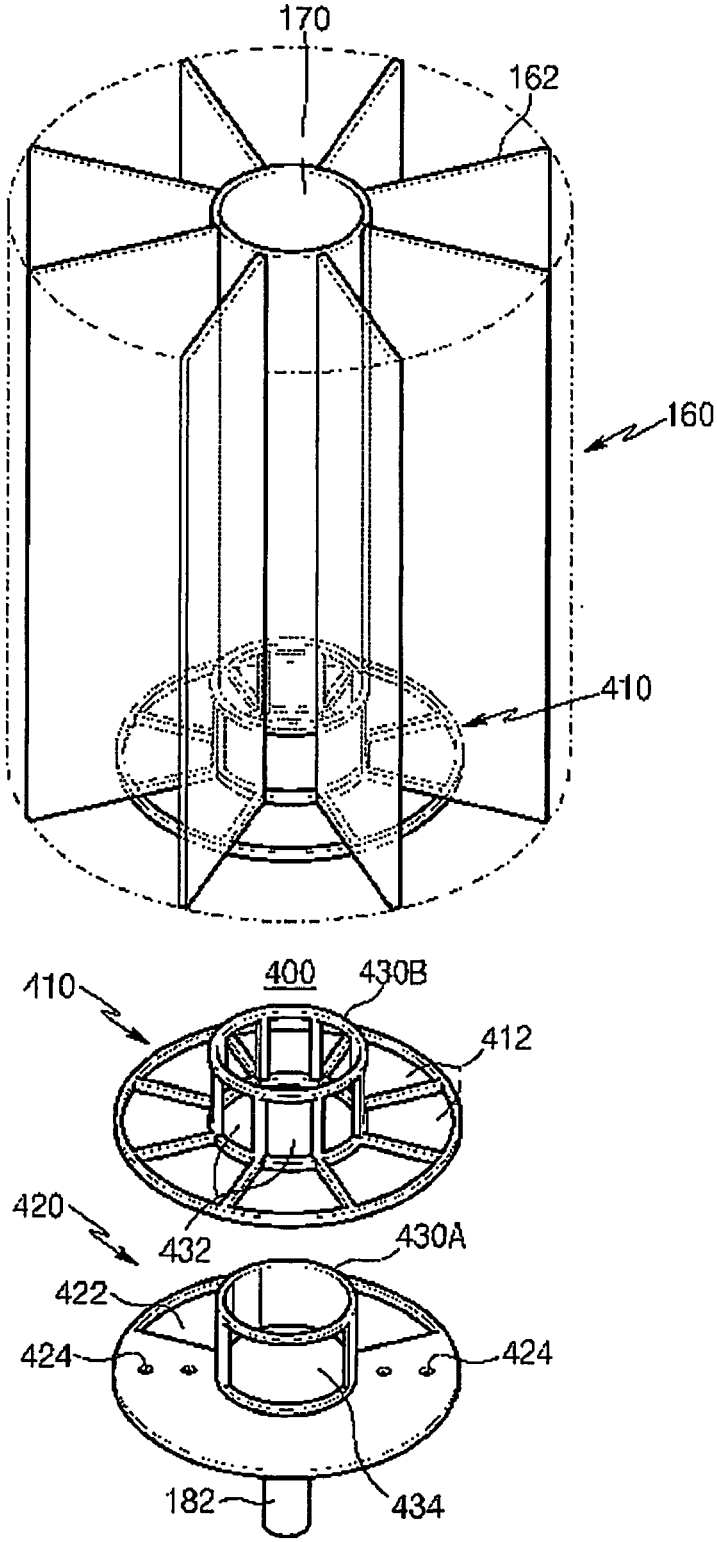
FIG. 7 is a perspective view to show a plate type distribution rotor, according to a further embodiment of the present invention.
Figure 8:
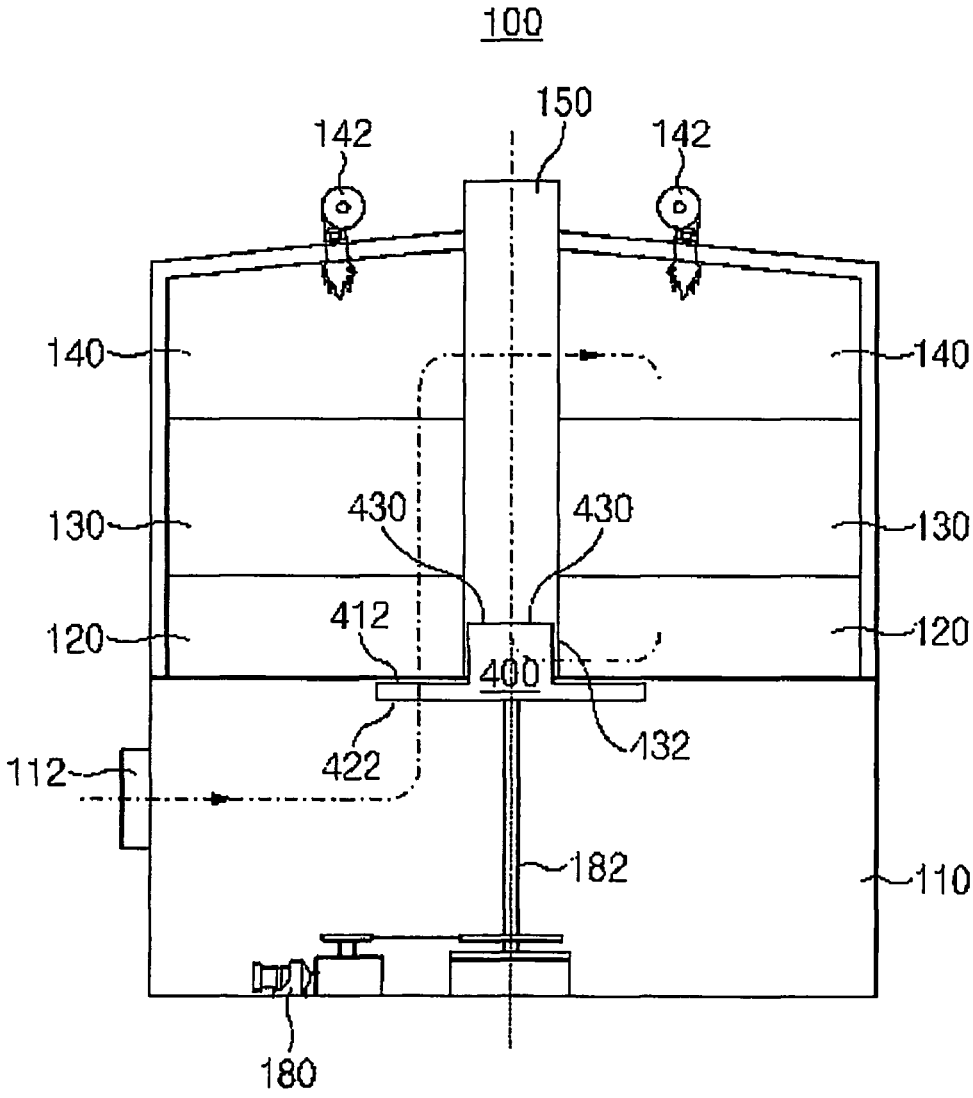
FIG. 8 is a sectional view of a regenerative thermal oxidizer having the rotor of FIG. 7.

FIGS. 7 and 8 are views to show a regenerative thermal oxidizer having a plate type distribution rotor, according to a third embodiment of the present invention.

FIG. 7 is a perspective view of the plate type distribution rotor used in the third embodiment.

Referring to FIG. 7, the rotor 400 includes an outer gas outlet 430B on a central portion thereof, and a distribution plate 410 which has a plurality of arc-shaped openings 412 along a circumference of the distribution plate 410. A plurality of outer slots 432 is provided on a sidewall of the outer gas outlet 430B. The size of each outer slot 432 may differ according to the width of each arc-shaped opening 412. The outer gas outlet 430B of the distribution plate 410 is fastened to a lower end of a separator 160 while being coupled to a first duct (150 in FIG. 8). The top of FIG. 7 illustrates the coupling of the distribution plate 410 to a lower end of a cylindrical pipe 170 of the separator 160.

Furthermore, the rotor 400 is in close contact with the distribution plate 410 and includes a rotating plate 420 which is rotated by a rotating shaft 182. The rotating plate 420 has an inner gas outlet 430A on a central portion thereof. An inner slot 434 is formed at a predetermined position on the inner gas outlet 430A. The rotating plate 420 further has an arc-shaped rotating opening 422 which is formed on a predetermined portion along a circumference of the rotating plate 420.

The distribution plate 410 and the rotating plate 420 constituting the rotor 400 are assembled together to function as a rotor type distribution unit. The inner gas outlet 430A of the rotating plate 420 is inserted into the outer gas outlet 430B of the distribution plate 410 to form together a single gas outlet set (430 in FIG. 8) which is integrally coupled to the first duct (150 in FIG. 8). The outer and inner slots 432 and 434, which are provided on the sidewalls of the outer and inner gas outlets 430B and 430A, respectively, guide process gases passing through a heat exchanging part (130 in FIG. 8) to the first duct 150, thus providing inlet and outlet process gas flow paths. The inner gas outlet 430A is rotatably inserted into the outer gas outlet 430B while a gap between them is sealed for airtight construction.

In the state of being assembled together, some of the arc-shaped openings 412 of the distribution plate 410 corresponding to the rotating opening 422 of the rotating plate 420 are associated with the inflow of the process gases into the heat exchanging part 130. The remaining arc-shaped openings 412, which do not correspond to the rotating opening 422 of the rotating plate 420, are not concerned with the inflow of the process gases. In the third embodiment, a purge gas feed path for an inflow of purge gas into the rotor 400 may be defined. FIG. 7 illustrates a purge gas feed hole 424 which is provided at a predetermined position on the rotating plate. A separate purge gas feed pipe may be coupled to the purge gas feed hole 424 to feed the purge gas from the outside, but it is not shown in the drawings. Unlike what is shown in the drawings, the purge gas feed hole 424 may be formed at a predetermined position on a sidewall of the inner gas outlet 430A of the rotating plate 420. Such a structure is advantageous in that the hollow rotating shaft 182 is used for feeding purge gas.

FIG. 8 is a sectional view of the regenerative thermal oxidizer having the rotor of the third embodiment.

In the regenerative thermal oxidizer 100 according to the third embodiment, the construction of the rotor 400 is different from those of the first and second embodiments. However, constructions of a combustion chamber 140, the heat exchanging part 130, a distribution chamber 120 and an inlet chamber 110 are similar to those of the first and second embodiments, therefore further explanation is deemed unnecessary.

With reference to FIG. 8, a process gas flow path is as follows (see, the arrow of the one-dot chain line). Process gases, drawn into the regenerative thermal oxidizer through a second duct 112, are supplied into the distribution chamber 120 along the inlet process gas flow path, which is defined by the openings 422 and 412 of the rotating plate 420 and the distribution plate 410 of the rotor, after passing through the inlet chamber 110. The drawn process gases pass through the heat exchanging part 130 and, thereafter, are burned in the combustion chamber 140. Thereafter, the burned process gases again pass through the heat exchanging part 130 prior to being guided to the first duct 150 through the inner and outer slots 434 and 432 of the gas outlet set 430 of the rotor 400.

In the regenerative thermal oxidizer 100 according to the third embodiment, the distribution chamber 120 must be airtightly assembled to the inlet chamber 110. To achieve the above-mentioned purpose, a predetermined sealing material is applied to an outer surface of the rotor 400. The distribution chamber 120 includes partitioning plates (162 in FIG. 7) which extend from the heat exchanging part 130 to the openings 412 and 422 of the rotor, thus preventing process gases drawn into the combustion chamber 140 and process gases discharged from the combustion chamber 140 from mixing with each other. The number of partitioning plates is determined by the number of sectors of the heat exchanging part 130.

In the same manner as the first and second embodiments, even in the third embodiment, the outlet and inlet process gas flow paths are formed at upper and lower parts of the regenerative thermal oxidizer, based on the rotor. Therefore, the present invention simplifies the structure for separating the inlet and outlet process gases from each other in the rotor 400 or the inlet chamber 110.

Hereinafter, a regenerative thermal oxidizer having a plate type distribution rotor according to a fourth embodiment will be described with reference to FIGS. 9 and 10. In regards to the rotor which is provided with a distribution ring having an inner space to separate inlet and outlet process gases from each other, the rotor of the fourth embodiment can be regarded as a combination of the above-mentioned plate type distribution rotor and the cylinder type distribution rotor.

Figure 9:
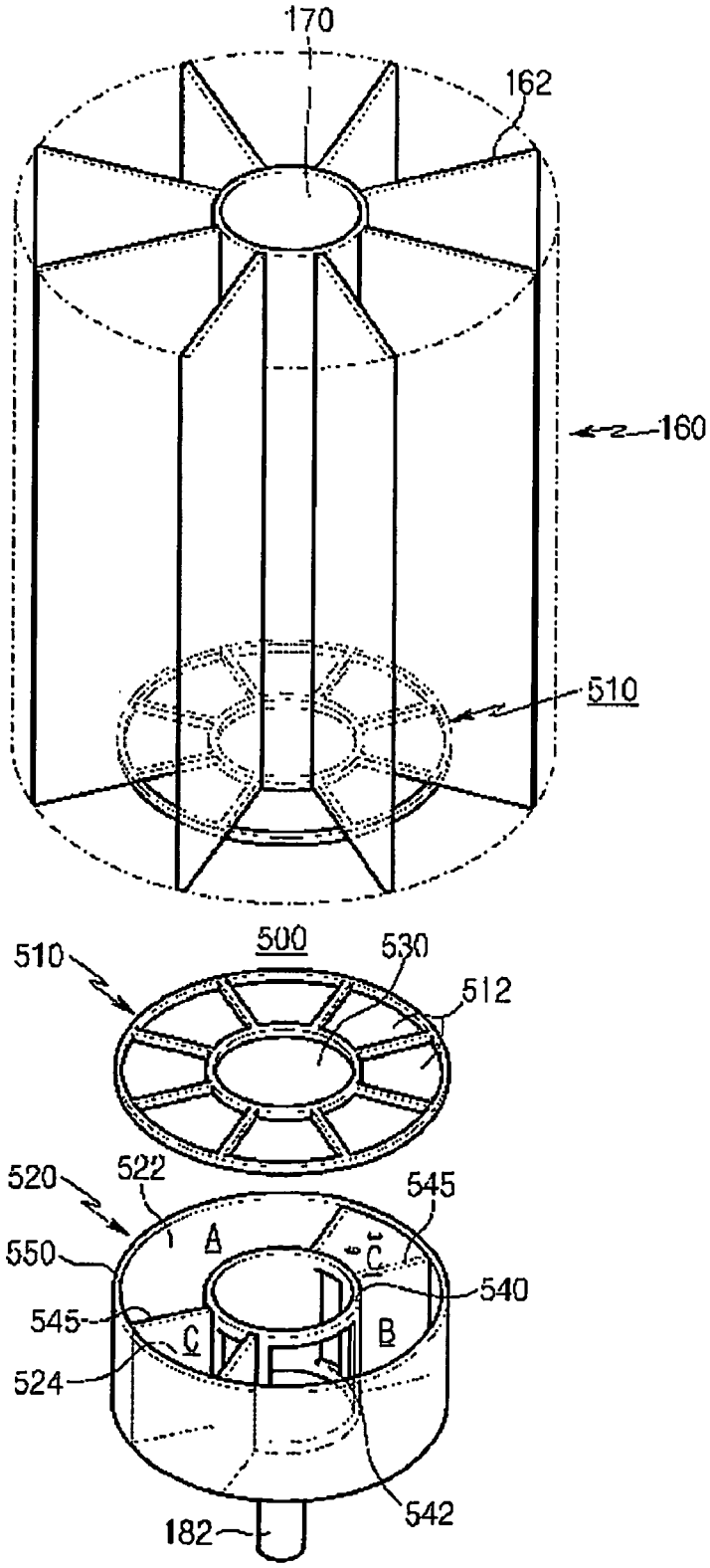
FIG. 9 is a perspective view to show a plate type distribution rotor, according to yet another embodiment of the present invention.

FIG. 9 is a perspective view to show the construction of the plate type distribution rotor 500 used in the fourth embodiment.

Referring to FIG. 9, the rotor 500 includes a distribution plate 510 and the distribution ring 520. A plurality of arc-shaped openings 512 is formed along the circumference of the distribution plate 510 around the center of the distribution plate 510 and spaced at regular angular intervals. The distribution plate 510 has a circular opening 530 on a central portion thereof. The circular opening 530 is coupled to a lower end of a cylindrical pipe 170 of a separator 160, thus being coupled to a first duct (150 in FIG. 10). The top of FIG. 9 illustrates the coupling of the distribution plate 510 to the lower end of the cylindrical pipe 170 of the separator 160.

The distribution ring 520 includes an inner ring 540 and an outer ring 550 which support each other by at least two partitioning blades 545. The inner ring 540 is in close contact with the circular opening 530 of the distribution plate 510 to communicate with the first duct 150. A junction part between the inner ring 540 and the circular opening 530 is airtightly sealed by a predetermined sealing material while the inner ring 540 and the circular opening 530 are rotatably assembled with each other. Furthermore, the inner ring 540 has a side opening 542. A rotating shaft is coupled to a lower end of the inner ring 540.

As shown in the drawings, a space between the inner ring and the outer ring is partitioned by the partitioning blades 545 into three regions. A first region (A) having an opening 545 relates to an inflow of process gases. The first region (A), which is called the inlet region (A), guides the process gases, drawn into the rotor 500, to a distribution chamber (120 in FIG. 10). A second region (B) communicates with the side opening 542 of the inner ring 540 and relates to an outflow of the process gases. The second region (B), which is called the outlet region (B), guides the burned process gases into the first duct. A third region (C) is defined between the inlet region (A) and the outlet region (B) and relates to a supply of purge gas for purging part of a heat exchanging part corresponding to the third region (C). When purge gas is drawn at a pressure higher than process gases, the supplied purge air may serve as an air curtain for preventing inlet process gases and outlet process gases from mixing with each other. A purge gas feed pipe associated with the supply of the purge gas through the purge gas feed region (C) is not shown in the drawings, but it is typically designed. For example, the purge gas passes through a hollow center axle of the rotating shaft 182 and, thereafter, is drawn into the purge gas feed region (C) through a predetermined pipe passing through the inner ring 540.

Figure 10:
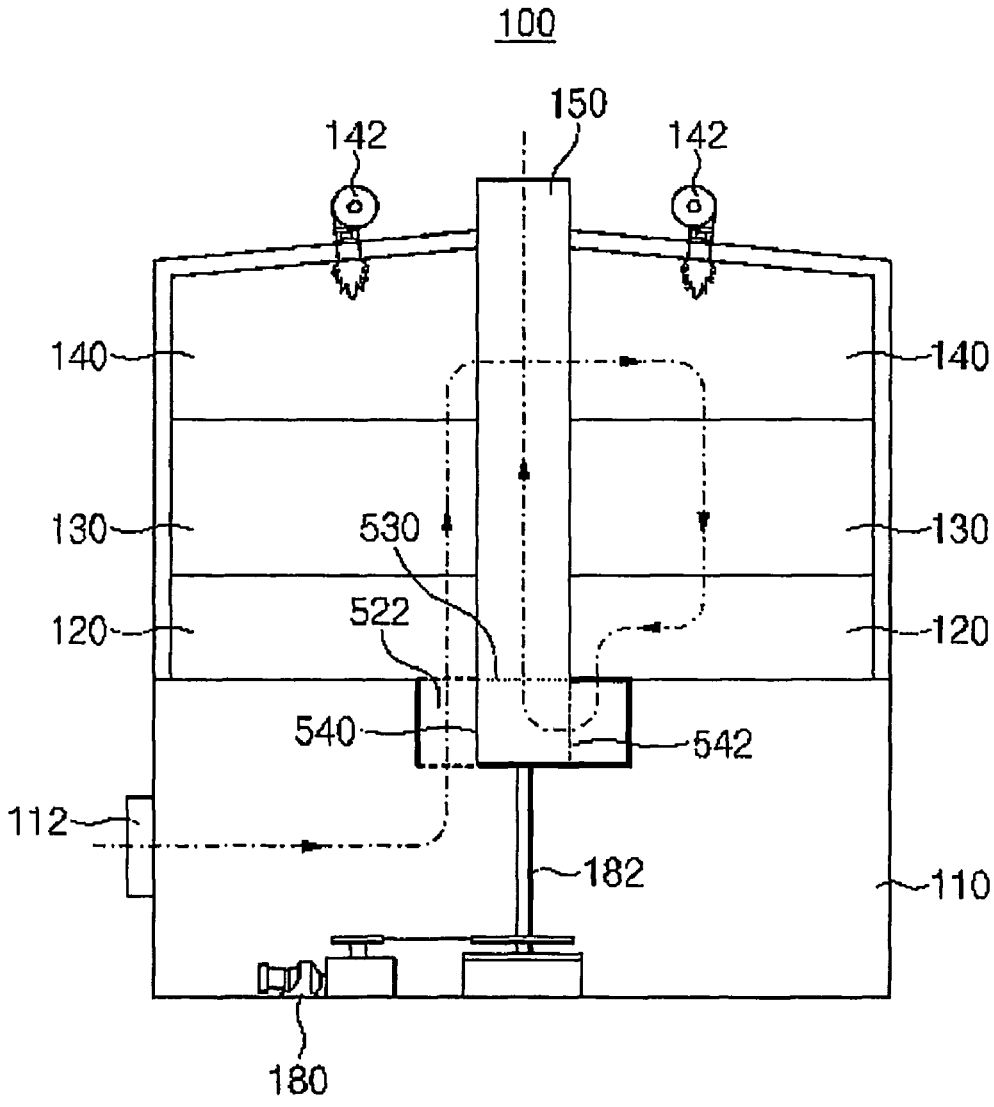
FIG. 10 is a sectional view of a regenerative thermal oxidizer having the rotor of FIG. 9.

FIG. 10 is a sectional view of the regenerative thermal oxidizer 100 provided with the above-mentioned rotor 500.

In this regenerative thermal oxidizer 100, the construction of the rotor 500 is different from those of the first through third embodiments. However, the construction of a combustion chamber 140, the heat exchanging part 130, a distribution chamber 120 and an inlet chamber 110 are similar to those of the first through third embodiments, therefore further explanation is deemed unnecessary.

With reference to FIG. 10, a process gas flow path is as follows (see, the arrow of the one-dot chain line). Process gases, drawn into the regenerative thermal oxidizer through a second duct 112, are supplied into the distribution chamber 120 through the inlet chamber 110 and the inlet region (A) of the outer ring 550 of the rotor 500. The drawn process gases pass through the heat exchanging part 130 and, thereafter, are burned in the combustion chamber 140. Thereafter, the burned process gases again pass through the heat exchanging part 130 prior to being guided to the first duct 150 through the outlet region (B) of the outer ring 550, the side opening 542 of the inner ring 540 and the circular opening 530 of the distribution plate 510 of the rotor 500.

The distribution chamber 120 includes partitioning plates (162 in FIG. 9) which extend to an upper end of the rotor 500, thus preventing process gases drawn into the combustion chamber 140 and process gases discharged from the combustion chamber 140 from mixing with each other. The partitioning plates 162 partition the heat exchanging part 130 into several sectors.

The regenerative thermal oxidizer provided with the rotor having the above-mentioned construction uses upper and lower surfaces of the rotor as outlet and inlet process gas flow paths. Therefore, the regenerative thermal oxidizer is advantageous in that the amount of process gases to be treated at one time is increased and, in addition, the construction of the rotor and the inlet chamber 110 is simplified.

In the above-mentioned embodiments of the present invention, the inlet and outlet process gas flow paths may be switched. In other words, in each of the embodiments, the first duct coupled to the upper end of the rotor may serve as an inlet pipe for the inflow of process gases and the second duct placed below the rotor may serve as an outer duct. Skilled persons will easily understand that, to achieve the above-mentioned purpose, the present invention requires the above-mentioned construction for the regenerative thermal oxidizer, but, it does not require a special construction difficult to realize by skilled persons.

In the above-mentioned embodiments of the present invention, although the regenerative thermal oxidizer having the heat exchanging part has been disclosed for illustrative purposes, the regenerative thermal oxidizer of the present invention may further include a catalyst layer on the heat exchanging part. As such, those skilled in the art will appreciate that various modifications, additions and substitutions are possible, without departing from the scope and spirit of the present invention.

INDUSTRIAL APPLICABILITY

As described above, the present invention provides a regenerative thermal oxidizer which has a distribution unit to distribute process gases above and below the distribution unit, so that the construction of the distribution unit is simplified and, as well, the present invention can treat a greater amount of process gases than conventional oxidizers in spite of having a distribution unit similar in size to conventional distribution units. Therefore, the present invention reduces the production costs of the regenerative thermal oxidizer and the costs of operating it.

The invention claimed is:

1. A regenerative thermal oxidizer to burn process gases, comprising:

a reaction chamber having a combustion unit to burn the process gases;

a heat exchanging part placed to be in contact with the reaction chamber and comprising a plurality of sectors for heat exchange of the process gases;

a first duct communicating with an outside through an upper end of the regenerative thermal oxidizer while passing through the heat exchanging part;

a second duct provided on a lower end of the regenerative thermal oxidizer to supply or discharge the process gases into or from the heat exchanging part;

a cylindrical rotor provided under the heat exchanging part, and comprising: an upper opening provided on an upper surface of the cylindrical rotor which is in contact with the first duct; and a lower opening provided on a lower surface of the cylindrical rotor opposite to the upper opening, wherein the upper opening provides a first gas flow path to connect some of the sectors of the heat exchanging part to the outside of the regenerative thermal oxidizer through the first duct, and the lower opening provides a second gas flow path to connect other sectors of the heat exchanging part to the outside of the regenerative thermal oxidizer through the second duct;

a plurality of partitioning plates to define the sectors of the heat exchanging part and to prevent the process gases passing through the first and second gas flow paths below the heat exchanging part from mixing with each other; and a drive unit coupled to a lower end of the cylindrical rotor to rotate the cylindrical rotor at a predetermined speed.

2. The regenerative thermal oxidizer according to claim 1, wherein the cylindrical rotor comprises upper and lower cylinders which are integrally operated, so that the upper opening is provided on the upper surface of the upper cylinder and the lower opening is provided on the lower surface of the lower cylinder, wherein the upper and lower cylinders comprise first and second side openings, respectively, so that both the upper opening and the first side opening are placed on the first gas flow path while both the lower opening and the second side opening are placed on the second gas flow path.

3. The regenerative thermal oxidizer according to claim 1, wherein the upper opening is provided on a central portion of the upper surface of the cylindrical rotor, and the lower opening is provided along a circumference of the lower surface of the cylindrical rotor, wherein the cylindrical rotor further comprises first and second side openings provided on opposite sidewalls of the cylindrical rotor, and both the upper opening and the first side opening are placed on the first gas flow path while both the second side opening and the lower opening are placed on the second gas flow path.

4. The regenerative thermal oxidizer according to claim 2 or 3, wherein the upper opening is rotatably in close contact with the first duct.

5. A regenerative thermal oxidizer to burn process gases, comprising:

a reaction chamber having a combustion unit to burn the process gases;

a heat exchanging part placed to be in contact with the reaction chamber and comprising a plurality of sectors for heat exchange of the process gases;

a first duct communicating with an outside through an upper end of the regenerative thermal oxidizer while passing through the heat exchanging part;

a second duct provided on a lower end of the regenerative thermal oxidizer to supply or discharge the process gases into or from the heat exchanging part;

a plate type distribution rotor provided under the heat exchanging part, and comprising: a gas outlet having a plurality of slots, communicating with the first duct, and provided on a central portion of the plate type distribution rotor; a plurality of openings provided on predetermined positions along a circumference of the plate type distribution rotor, wherein the gas outlet having the plurality of slots provides a first gas flow path to connect some of the sectors of the heat exchanging part to the outside of the regenerative thermal oxidizer through the first duct, and the plurality of openings provides a second gas flow path to connect other sectors of the heat exchanging part to the outside of the regenerative thermal oxidizer through the second duct;

a plurality of partitioning plates to define the sectors of the heat exchanging part while extending to a lower end of the heat exchanging part to prevent process gases passing through the first and second gas flow paths from mixing with each other; and a drive unit coupled to a lower end of the plate type distribution rotor to rotate the plate type distribution rotor at a predetermined speed.

6. A regenerative thermal oxidizer to burn process gases, comprising:

a reaction chamber having a combustion unit to burn the process gases;

a heat exchanging part placed to be in contact with the reaction chamber and comprising a plurality of sectors for heat exchange of the process gases;

a first duct communicating with an outside through an upper end of the regenerative thermal oxidizer while passing through the heat exchanging part;

a second duct provided on a lower end of the regenerative thermal oxidizer to supply or discharge the process gases into or from the heat exchanging part;

a ring type distribution rotor provided under the heat exchanging part, and comprising: two concentric rings comprising an inner ring and an outer ring; and at least two partitioning blades extending from an outer surface of the inner ring to the outer ring to partition the outer ring into at least two sections, wherein the inner ring is coupled to the first duct and provides a first gas flow path to connect some of the sectors of the heat exchanging part to the outside of the regenerative thermal oxidizer through the first duct and a side opening of the inner ring, and the outer ring provides a second gas flow path to connect other sectors of the heat exchanging part to the outside of the regenerative thermal oxidizer through the second duct and a part of the sections partitioned by the partitioning blades;

a plurality of partitioning plates to define the sectors of the heat exchanging part while extending to a lower end of the heat exchanging part to prevent the process gases passing through the first and second gas flow paths from mixing with each other; and a drive unit coupled to a lower end of the ring type distribution rotor to rotate the ring type distribution rotor at a predetermined speed.

7. The regenerative thermal oxidizer according to claim 6, further comprising:

a distribution plate mounted to the first duct and having a plurality of openings to distribute the process gases to be supplied into or discharged from the ring type distribution rotor.

8. A regenerative thermal oxidizer to burn process gases, comprising:

a reaction chamber having a combustion unit to burn the process gases;

a heat exchanging part placed to be in contact with the reaction chamber and comprising a plurality of sectors for heat exchange of the process gases;

a first duct communicating with an outside through an upper end of the regenerative thermal oxidizer while passing through the heat exchanging part;

a second duct provided on a lower end of the regenerative thermal oxidizer to supply or discharge the process gases into or from the heat exchanging part;

a rotor-shaped distribution unit placed to be in close contact with the first duct and provide both a first gas flow path which is associated with the first duct and provided above the rotor-shaped distribution unit and a second gas flow path which is associated with the second duct and provided below the rotor-shaped distribution unit;

a plurality of partitioning plates to define the sectors of the heat exchanging part while extending to a lower end of the heat exchanging part to prevent the process gases passing through the first and second gas flow paths from mixing with each other; and a drive unit to rotate the rotor at a predetermined speed.

* * * * *